US005747146A

United States Patent [19]

Kashiwazaki et al.

[11] Patent Number: 5,747,146

[45] Date of Patent: May 5, 1998

[54] PRINTING MEDIUM AND INK JET PRINT

[75] Inventors: Akio Kashiwazaki; Masato Katayama, both of Yokohama; Kenichi Moriya, Tokyo, all of Japan

[73] Assignee: Canon Kabushiki Kaisha, Tokyo, Japan

[21] Appl. No.: 392,153

[22] Filed: Feb. 22, 1995

[30] Foreign Application Priority Data

| | | | |
|---|---|---|---|
| Feb. 24, 1994 | [JP] | Japan | 6-026812 |
| Mar. 14, 1994 | [JP] | Japan | 6-042449 |
| Mar. 30, 1994 | [JP] | Japan | 6-060920 |
| Aug. 3, 1994 | [JP] | Japan | 6-182300 |
| Feb. 2, 1995 | [JP] | Japan | 7-015869 |
| Feb. 2, 1995 | [JP] | Japan | 7-015871 |
| Feb. 2, 1995 | [JP] | Japan | 7-015872 |

[51] Int. Cl.[6] ..... B41M 5/00

[52] U.S. Cl. ..... 428/206; 428/195; 428/211; 428/323; 428/328; 428/329; 428/330; 428/331; 428/409; 428/520

[58] Field of Search ..... 428/195, 323, 428/328, 329, 331, 520, 206, 211, 330, 409

[56] References Cited

U.S. PATENT DOCUMENTS

| | | | |
|---|---|---|---|
| 4,636,805 | 1/1987 | Toganoh et al. | 346/1.1 |
| 4,723,129 | 2/1988 | Endo et al. | 346/1.1 |
| 4,740,796 | 4/1988 | Endo et al. | 346/1.1 |
| 4,849,774 | 7/1989 | Endo et al. | 346/140 R |
| 5,122,814 | 6/1992 | Endo et al. | 346/33 R |
| 5,159,349 | 10/1992 | Endo et al. | 346/33 A |
| 5,362,558 | 11/1994 | Sakaki et al. | 428/323 |

FOREIGN PATENT DOCUMENTS

| | | |
|---|---|---|
| 0514633 | 11/1992 | European Pat. Off. . |
| 3510565 | 9/1985 | Germany . |
| 54-059936 | 5/1979 | Japan . |
| 57-093193 | 6/1982 | Japan . |
| 59-095188 | 6/1984 | Japan . |
| 60-220750 | 11/1985 | Japan . |
| 62-170383 | 7/1987 | Japan . |
| 3025352 | 4/1991 | Japan . |
| 5-131741 | 5/1993 | Japan . |

OTHER PUBLICATIONS

Patent Abstracts of Japan, Ink Jet Recording Paper Having Strong Gloss, vol. 11, No. 14, Jan. 14, 1987.

*Primary Examiner*—Pamela R. Schwartz

*Attorney, Agent, or Firm*—Fitzpatrick, Cella, Harper & Scinto

[57] ABSTRACT

Disclosed herein is a printing medium comprising a base material and an ink-receiving layer which comprises inorganic fine particles and a binder and is provided on the base material, wherein the inorganic fine particles are partly projected from a binder layer of the ink-receiving layer and contained in a proportion of 0.05 to 3 parts per 100 parts of the binder in terms of solids.

20 Claims, 3 Drawing Sheets

PRINTING MEDIUM AND INK JET PRINT

BACKGROUND OF THE INVENTION

1. Field of the Invention

The present invention relates to a printing medium suitable for use in ink-jet printing, a production process thereof, and an ink-jet printing method using this medium.

2. Related Background Art

An ink-jet printing method is a method in which printing is conducted by generating and flying droplets of an ink by one of various ink ejection systems, for example, an electrostatic attraction system, a system using a piezoelectric element to give an ink a mechanical vibration or change, or a system in which an ink is heated to form bubbles in the ink to use the pressure thus produced, and applying the droplets in whole or in part to a printing material such as paper or a plastic film coated with an ink-receiving layer. The ink-jet printing method attracts attention as a printing method which scarcely produces noise and can conduct high-speed printing and multi-color printing.

As inks for ink-jet printing, inks comprising water as a principal component are mainly used from the viewpoints of safety, printability and the like. A polyhydric alcohol and/or the like are often added to such inks with a view toward preventing clogging of orifices and improving ejection stability.

As printing materials suitable for use in ink-jet printing, there have hitherto been used glossy paper as described in Japanese Patent Publication No. 3-25352, which comprises a cast-coated paper web and a film formed thereon comprising polyvinyl alcohol having a saponification degree of from 50 to 90 mole % and a crosslinking agent, and a printing sheet for an over-head projector (OHP) as described in Japanese Patent Application Laid-Open No. 60-220750, which comprises a polyester film and a hydrophilic film provided thereon composed of water-soluble polyvinyl alcohol having a saponification degree of from 70 to 90 mole %.

With the improvement in performance of ink-jet printing apparatus, such as speeding up of printing and multi-coloring of images, in recent years, ink-jet printing media have been also required to have higher and wider properties.

More specifically, they are required to simultaneously satisfy, for example, the following properties:

(1) having high ink absorptivity (absorbing capacity being great, and absorbing time being short);

(2) providing dots high in optical density and clear in periphery;

(3) providing dots having a substantially round shape and a smooth periphery;

(4) undergoing scarce changes in the properties even at varied temperatures and humidities and no curling;

(5) undergoing no blocking;

(6) being able to stably store images formed thereon for a long period of time without deterioration (in particular, in a high-temperature and high-humidity environment);

(7) being stable without undergoing deterioration even when stored for a long period of time (in particular, in a high-temperature and high-humidity environment); and (8) having good feeding property so as to smoothly move when charged into a printer and printed.

More recently, printing media have been strongly requested to have good continuous feeding property in various printers.

Besides, printing sheets for OHP, and the like are further required to have excellent transparency in addition to the above requirements.

These properties are often in a relation of trade-off. It has hence been impossible to satisfy them at the same time by the conventionally known techniques. For example, the exemplified recording media of the prior art have comparable performance in dot shape and blocking resistance, but are poor in ink absorptivity. Therefore, they cause image smearing and unevenness of color strength due to ink running at areas high in image density, i.e., areas great in shot-in ink quantity. In addition, they cause color muddiness due to mixing of colors at boundaries between different colors, particularly, in the case of color printing.

Further, it has recently been reported to use inks in which values of physical properties such as surface tension are different between a black ink and color inks to lessen bleeding between the black ink and the color inks. However, there are few examples of a printing material which exhibits good printability to all the inks different in physical property values. Further, any film for OHP satisfying the overall performance taking other properties such as fixing ability into consideration has not been yet obtained.

With the progress of speeding up of recording, increasing of image density and coloring of images, and diversification of inks, as described above, defective ink fixing, deteriorated image quality and lowered shelf stability of the resulting print have become serious problems.

Besides, in these existing constructions, no attention is paid to improvement in feeding property and continuous feeding property in various printers, which is particularly strongly required at present, as to the film for OHP, glossy paper or the like. Therefore, a major problem has been left in this respect. It has been scarcely proposed at present to improve the feeding property and continuous feeding property, and so such a problem must be solved.

Further, as described in, for example, Japanese Patent Application Laid-Open Nos. 59-95188, 57-93193 and 62-170383, it has been reported to use an aqueous resin emulsion as a material of an ink-receiving layer. According to these compositions, an improving effect is recognized to some extent as to blocking. However, no improving effect is recognized at to the problem of the feeding property and continuous feeding property.

In addition, these printing media cause image smearing and unevenness of color strength due to ink running at areas high in image density, i.e., areas great in shot-in ink quantity.

SUMMARY OF THE INVENTION

It is thus an object of the present invention to provide a light-transmitting or surface-gloss printing medium which satisfies both of image properties and properties of printing medium itself such as blocking resistance, and feeding property and continuous feeding property in various printers in a well-balanced relation, and an ink-jet printing method using this printing medium, and moreover to provide a light-transmitting or surface-gloss printing medium excellent in fixing ability, stackability after printing and the like, and an ink-jet printing method using this printing medium.

Another object of the present invention is to provide a printing medium which scarcely undergoes deterioration even when the printing medium itself or an image formed thereon is left to stand for a long period of time in a high-temperature and high-humidity environment, and is excellent in fixing ability, stackability after printing and the like, and an ink-jet printing method using this printing medium.

The above objects can be achieved by the present invention described below.

According to the present invention, there is thus provided a printing medium comprising a base material and an ink-receiving layer which comprises inorganic fine particles and a binder and is provided on the base material, wherein the inorganic fine particles are partly projected from a binder layer of the ink-receiving layer and contained in a proportion of 0.05 to 3 parts per 100 parts of the binder in terms of solids.

According to the present invention, there is also provided a printing medium comprising a base material and an ink-receiving layer provided on at least one side of the base material, wherein the ink-receiving layer has a structure that resin particles are held in a continuous film of a water-soluble resin, and inorganic fine particles are partly projected from the surface of the ink-receiving layer.

According to the present invention, there is further provided an ink-jet printing method comprising ejecting an ink on any one of the printing media described above from an orifice of a recording head in accordance with a recording signal, thereby conducting printing.

According to the present invention, there is still further provided a process for producing a printing medium comprising a base material and an ink-receiving layer provided on at least one side of the base material, which comprises applying a coating formulation comprising, as essential components, cationically modified polyvinyl alcohol, an aqueous resin emulsion and inorganic fine particles to the base material to form the ink-receiving layer in such a manner that the resulting ink-receiving layer has a structure that resin particles from the aqueous resin emulsion are held in the ink-receiving layer, and the inorganic fine particles are partly projected from the surface of the ink-receiving layer.

According to the present invention, there is yet still further provided a printing medium comprising a base material and an ink-receiving layer provided on at least one side of the base material, wherein the ink-receiving layer comprises, as essential components, a water-soluble resin, a copolymer of vinylpyrrolidone and a hydrophobic monomer, and inorganic fine particles, and the inorganic fine particles are partly projected from the surface of the ink-receiving layer.

According to the present invention, there is yet still further provided a method of forming images, which comprises forming an image on the printing medium described above by means of an ink-jet system.

DESCRIPTION OF THE PREFERRED EMBODIMENTS

In the course of developing printing paper suitable for use in ink-jet printing and a transparent film for over-head projectors, the present inventors have found printing media which are excellent in fixing ability and stackability after printing, far excellent in feeding property and continuous feeding property in various printers and satisfy these performance characteristics without deteriorating printing properties and image quality to any extent, thus leading to completion of the present invention.

Figure 1A:
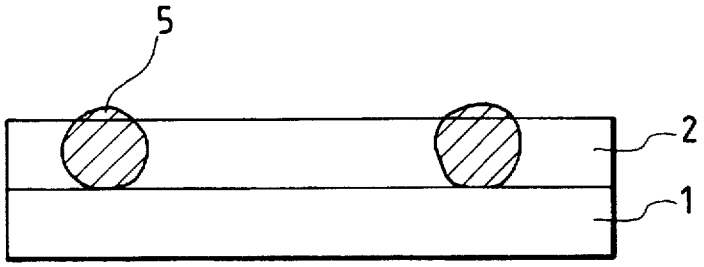
FIGS. 1A and 1B are cross-sectional views illustrating examples of printing media according to the present invention.

More specifically, as illustrated in FIG. 1A, the inorganic fine particles 5 are partly projected from the surface of the binder layer of the ink-receiving layer 2, whereby the printing medium is improved in a tendency to be caught by pickup rollers in various printers, and so good feeding property to smoothly move can be realized. When the construction according to the present invention is used, blocking resistance also becomes good, and so entirely satisfactory performance can be achieved as to the continuous feeding property.

Further it has been definitely shown that the use of the constitution that the inorganic fine particles are used, and they are projected from the binder layer can lessen bleeding to a significant extent compared with the use of organic fine particles, and also improve the ability to keep the quality of an image formed on the printing medium good.

Examples of the inorganic fine particles useful in the practice of the present invention include fine particles of silica, alumina, aluminum silicate, magnesium silicate, basic magnesium carbonate, talc, clay, hydrotalcite, calcium carbonate, titanium oxide and zinc oxide. It goes without saying that they are not limited to these particles. Ink absorptiveness is not very required of these inorganic fine particles.

For example, if particles of a high-water-absorptive resin are used as fine particles, the resin particles themselves also absorb ink to swell. As a result, the mechanical strength of the resin particles is lowered, and so the tendency to be caught by a pickup roller is deteriorated to a significant extent. Therefore, the feeding property and continuous feeding property of such a printing medium become different from a practicable level.

In this case, if the inorganic fine particles are used, the mechanical strength can be kept good even after printing, and so the objects of the present invention can be satisfied.

In order to make the effects of the invention clear, it is also necessary to partly project the inorganic particles from the surface of the binder layer of the ink-receiving layer as described above.

With respect to a method of making such a structure, if the primary particle diameter of fine particles to be used, or the secondary particle diameter or average particle diameter thereof if the particles are liable to aggregate is greater than the thickness of the binder layer, it is ensured that the ink-receiving layer is constructed so as to project the inorganic particles from the surface of the binder layer of the ink-receiving layer. Even if the primary particle diameter of the fine particles to be used is smaller than the thickness of the binder layer, it is also consequentially possible to project the inorganic fine particles from the surface of the binder layer of the ink-receiving layer owing to fine particles existing in the surface of the binder layer. Since the fine particles are fully considered to exist in an aggregated state (in the form of secondary particles) (they generally exist in this form), the ink-receiving layer may be constructed so as to project the inorganic fine particles from the surface of the binder layer even if fine particles small in diameter are used.

However, if the average particle diameter of these inorganic fine particles exceeds 5 times the thickness of the binder layer of the ink-receiving layer, a phenomenon of reduced surface strength, dusting or the like presents itself. It is hence not preferable to use fine particles having such a great diameter. On the other hand, it is consequentially possible for the ink-receiving layer to take a structure that the inorganic fine particles are projected from the surface of the binder layer even if the average particle diameter of these inorganic fine particles is smaller than a fifth the thickness of the binder layer. However, if inorganic fine particles having an average particle diameter smaller than a fifth the thickness of the binder layer are used, the amount of the particles to be used becomes considerably great for satisfying the effect to fully exhibit the present invention, i.e., the feeding property to smoothly move and the continuous feeding property. As a result, the transparency of the resulting printing medium is lowered (its haze degree is increased) even if a transparent film is used as a base material, and so it becomes departed from a practicable level as a film for OHP.

In order to keep this transparency or surface gloss to the practicable level, it is necessary to use inorganic fine particles having an average particle diameter not smaller than a fifth the thickness of the binder layer.

As the most preferred embodiment in the present invention, may be mentioned the use of inorganic fine particles greater than the thickness of the binder layer.

The content of these inorganic fine particles in the binder layer is preferably of the order of 0.05 to 3 parts per 100 parts of the binder component in terms of solids. If this content is lower than 0.05 part, the effects according to the present invention are not fully exhibited. On the other hand, any content exceeding 3 parts is rendered transparency or surface gloss lower.

No particular limitation is imposed on a resin used as the binder layer so far as it can receive the so-called water-based ink and shows solubility in or affinity for the water-based ink. Examples of such a resin include water-soluble resins, for example, synthetic resins such as polyvinyl pyrrolidone, polyvinyl alcohol, anionically modified polyvinyl alcohol, cationically modified polyvinyl alcohol, polyurethane, carboxymethylcellulose, polyester, polyacrylic acid (esters), polyacrylamide, hydroxyethylcellulose, hydroxypropylcellulose, melamine resins and modified products thereof; and natural resins such as albumin, gelatin, casein, starch, cationic starch, gum arabic and sodium alginate, to which, however, are not limited.

In the present invention, a water-dispersible resin (emulsion) may be used as the binder layer. As examples of such resins, may be mentioned a great number of resins such as polyvinyl acetate, ethylene-vinyl acetate copolymers, polystyrene, styrene-(meth)acrylate copolymers, (meth) acrylate polymers, vinyl acetate-(meth)acrylic acid (ester) copolymers, poly(meth)acrylamide, (meth)acrylamide copolymers, styrene-isoprene copolymers, styrene-butadiene copolymers, ethylene-propylene copolymers and polyvinyl ether. However, it goes without saying that such resins are not limited to these resins.

Pluralities of these water-soluble resins and water-dispersible resins may be used respectively or simultaneously at the same time.

In a preferred embodiment of the present invention, the binder layer is constructed so as to have a structure that resin particles are held in a continuous film of a water-soluble resin, particularly, cationically modified polyvinyl alcohol. The printing medium having such a structure is extremely high in ink absorptivity, can provide bright and sharp dots, is excellent in blocking resistance, undergoes scarce changes in the performance even under environmental conditions of varied temperatures and humidities, can be stably stored for a long period of time, in particular, in a high-temperature and high-humidity environment. Further the printing medium can form images stable to long-term storage in a high-temperature and high-humidity environment, and is excellent in fixing ability and stackability after printing.

More specifically, it is considered that when the cationically modified polyvinyl alcohol is contained in the binder layer, the affinity for inks having various properties, in particular, for water, or water-miscible glycols or glycol ethers is enhanced, and so the ink absorptivity of the resulting ink-receiving layer becomes extremely high, whereby an image bright and sharp in-dots is provided. In addition, changes in the performance become slight even under environmental conditions of varied temperatures and humidities. In order to solve the problems of the fixing ability, stackability after printing and the like involved in the use of the cationically modified polyvinyl alcohol, the above-described aqueous resin emulsion is further contained therein. As a result, it is possible to markedly improve the above-mentioned performance characteristics so as to satisfy the overall performance as a film for OHP.

The cationically modified product of polyvinyl alcohol (hereinafter abbreviated as PVA) useful in the practice of the present invention means PVA having a cationic group such as a primary, secondary or tertiary amino group, or a quaternary ammonium group. PVA is generally obtained by saponifying polyvinyl acetate by the acid saponification or alkali saponification. Besides, the cationically modified product of PVA used in the present invention, which makes up the printing medium, is obtained by a method in which an ordinary PVA is directly cationized with a cationizing agent having a cationic group such as glycidyltrimethylammonium chloride and a group reactive to the OH group in the PVA at the same time, a method in which vinyl acetate and a monomer having a reactive group are copolymerized, the resulting copolymer is saponified, and the saponified product is then reacted with a cationic group-containing compound making good use of such a reactive group to obtain a cationically modified PVA, or a method in which a cationic monomer is added upon the polymerization of vinyl acetate as a raw material to copolymerize them, and the resulting copolymer is saponified by a method known per se in the art.

As cationic monomer used in such copolymerization, may be mentioned vinyloxyethyltrimethylammonium chloride, 2,3-dimethyl-1-vinylimidazolium chloride, trimethyl-(3-acrylamido-3, 3-dimethylpropyl)ammonium chloride, trimethyl-(3-methacrylamidopropyl)ammonium chloride, and primary to tertiary amine precursors thereof; N-(1,1-dimethyl-3-dimethylaminopropyl)acrylamide, N-(3-dimethylaminopropyl)methacrylamide, o-, m- and p-aminostyrenes, and monoalkyl and dialkyl derivatives and quaternary ammonium salts thereof; o-, m- and p-vinylbenzylamines, and monoalkyl and dialkyl derivatives and quaternary ammonium salts thereof; N-(vinylbenzyl) pyrrolidine; N-(vinylbenzyl)piperidine; N-vinylpyrrolidone; α- and β-vinylpyridines and quaternary ammonium salts thereof; α- and β-vinylpiperidines and quaternary ammonium salts thereof; nitrogen-containing heterocyclic vinyl compounds other than the above, such as 2- and 4-vinylquinolines and quaternary ammonium salts thereof, and vinyl compound monomers easy to be converted into cationic compounds, such as nitro derivatives thereof. Vinyloxyethyl-trimethylammonium chloride, 2,3-dimethyl-1-vinyl-imidazolium chloride, trimethyl-(3-acrylamido-3,3-dimethylpropyl)ammonium chloride, trimethyl-(3-methacrylamidopropyl)ammonium chloride and primary to tertiary amine precursors thereof, N-(1,1-dimethyl-3-dimethylaminopropyl)acrylamide, and N-(3-dimethylamino-propyl)methacrylamide are preferred taking account of copolymerizability, stability upon the saponification of an acetate group, and the like.

The amount of cationic groups existing in such a cationically modified PVA is preferably within a range of from 0.05 to 30 mole %, more preferably from 0.1 to 10 mole % of the total monomer unit in terms of molar fraction of monomer units in the polymer. If the existing amount of the cationic groups is lower than 0.05 mole %, improving effects on water resistance of the ink-receiving layer and ink-jet printing properties such as resolution of images and coloring ability are not fully achieved even as compared with the case where unmodified PVA is used. On the other hand, if the amount exceeds 30 mole %, adhesion of the ink-receiving layer to a base material and film-forming property are deteriorated. In addition, the compatibility of such a modified PVA with the aqueous resin emulsion, which will be described subsequently, is also adversely affected.

The saponification degree of the PVA used as a backbone polymer is preferably 70 to 99 mole %, more preferably 74 to 95 mole %. The polymerization degree of the cationically modified PVA is preferably 300 to 5,000, more preferably 500 to 3,000. In each case, polymers different in polymerization degree or saponification degree may be used in combination.

As examples of the aqueous resin emulsion useful in the practice of the present invention, may be mentioned, in addition to those mentioned above, emulsions of silicone-acrylic copolymers, copolymers containing N-methylolacrylamide as units, and copolymers of vinylpyrrolidone and a hydrophobic monomer.

Of these aqueous resin emulsions, the emulsions composed of the copolymers of vinylpyrrolidone and a hydrophobic monomer are particularly preferred because such a copolymer gives the resulting ink-receiving layer both good affinity for inks by the vinylpyrrolidone moiety and high mechanical strength of the film and good environmental resistance by the hydrophobic monomer moiety, and so the effects of the present invention can be achieved.

As examples of the hydrophobic monomer used, may be mentioned aromatic vinyl compounds such as styrene, α-methylstyrene and vinylnaphthalene; esters of (meth) acrylic acid and other unsaturated carboxylic acids such as crotonic acid; and vinyl acetate and vinyl butyrate. However, no particular limitation is imposed on the hydrophobic monomer so far as it is copolymerizable with vinylpyrrolidone.

Of these, styrene and (meth)acrylic esters are preferred because feeding property to various inks, image quality, blocking resistance, stackability after printing and the like can be markedly improved at the same time.

The mixing ratio of vinylpyrrolidone to the hydrophobic monomer is preferably within a range of from 1/9to 9/1. The molecular weight of this polymer is preferably within a range of from 500 to 1,000,000.

The content in terms of solids of these aqueous resin emulsions in the binder layer is preferably within a range of from 0.1 to 50% by weight, more preferably from 1 to 30% by weight based on the content of the cationically modified polyvinyl alcohol. If the content is lower than 0.1% by weight, the effects of the present invention, i.e., improvements of fixing ability, stackability after printing and the like are not fully achieved. If the content exceeds 50% by weight on the other hand, the ink receptivity of the resulting ink-receiving layer is rapidly lowered, and so problems are easy to arise as to image properties, in particular, evenness and resistance to bleeding.

The minimum film-forming temperature (MFT) of the aqueous resin emulsion used in the present invention is desirably at least 20° C., preferably at least 30° C. More specifically, the use of an aqueous resin emulsion having an MFT lower than 20° C. results in an ink-receiving layer having a less effect on the improvement of fixing ability as compared with the case where an aqueous resin emulsion having an MFT of at least 20° C. is used. The reason for this is considered to be attributable to the fact that fusion bonding between resin particles in the emulsion (hereinafter referred to as emulsion particles), and film formation are allowed to overprogress upon formation of a film by heating, and so the emulsion particles cannot maintain their particle form. Bleeding also becomes somewhat easier to occur compared with the case where the aqueous resin emulsion having an MFT of at least 20° C. is used.

The size (diameter) of the emulsion particles is preferably smaller than the thickness of the ink-receiving layer formed, specifically, not greater than 10 μm, preferably not greater than 5 μm. The lower limit of the particle size is about 0.01 μm.

Figure 1B:
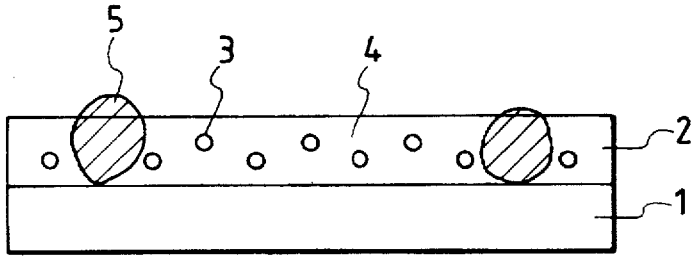

The MFT and particle diameter of the aqueous resin emulsion, the mixing ratio of the cationically modified polyvinyl alcohol to the aqueous resin emulsion, drying conditions of a coating layer, and the like are suitably adjusted, whereby an ink-receiving layer 2 having a structure that resin particles 3 are held in a continuous film 4 of the cationically modified polyvinyl alcohol, and the inorganic fine particles 5 are partly projected from the surface of the coating layer as illustrated in FIG. 1B can be formed on a base material 1.

In the present invention, a composition containing the above-described binder components and inorganic fine particles as essential components is applied to at least one side of a base material to obtain a printing medium having an ink-receiving layer on the surface of the base material. Various additives may be mixed in this composition within limits not impeding the achievement of the objects of the present invention.

Specific examples of the additives include various surfactants, dye-fixing agents (water-proofings), antifoaming agents, antioxidants, optical whitening agents, ultraviolet absorbents, dispersing agents, viscosity modifiers, pH adjustors, mildew-proofing agents and plasticizers. These additives may be optionally selected from the conventionally-known compounds as necessary for the end application intended.

Another cationic compound may be further contained in the composition with a view toward improving shelf stability of images formed. No particular limitation is imposed on the cationic compound so far as it contains a cationic moiety in its molecule. As examples thereof, may be mentioned cationic surfactants of the quaternary ammonium salt type, such as monoalkylammonium chlorides, dialkylammonium chlorides, tetramethylammonium chloride, trimethylphenylammonium chloride and ethylene oxide-added ammonium chlorides, and cationic surfactants of the amine salt type. Besides, amphoteric surfactants such as alkylbetaines, imidazolinium betaines and alanine derivatives, which contain a cationic moiety, may be used.

As cationic polymers or oligomers, may be mentioned cationically modified products of polyacrylamide or copolymers of acrylamide and a cationic monomer, polyethyleneimine, polyamide-epichlorohydrin resins, polyvinylpyridinium halides, polyamine resin such as polyallylamine, polyamine sulfone and polyvinylamine, etc.

Further, homopolymers of vinylpyrrolidone monomers or their copolymers with other common monomers, homopolymers of vinyloxazolidone monomers or their copolymers with other common monomers, homopolymers of vinylimidazole monomers or their copolymers with other common monomers, etc. may be mentioned. The common monomers include methacrylates, acrylates, acrylonitrile, vinyl ethers, vinyl acetate, ethylene, styrene and the like.

The content of these cationic compounds in the ink-receiving layer is desirably within a range of from 0.01 to 30% by weight based on the content of the cationically modified PVA, which is a principal compound used in the present invention, in the ink-receiving layer.

Any content lower than 0.01% by weight results in a printing medium having no marked effect on the formation of images stable to long-term storage in a high-temperature and high-humidity environment even as compared, with the case where no cationic compound is added. Any content exceeding 30% by weight results in a printing medium too high in hygroscopicity and easy to cause blocking. In addition, its recording surface is low in mechanical strength and becomes easy to flaw.

As the base material constituting the printing medium according to the present invention, there may be used a paper web such as wood free paper, medium-quality paper, art paper, glossy paper, bond paper, recycled paper, baryta paper, cast-coated paper, corrugated fiberboard, nonwoody paper or synthetic paper, a film of a plastic such as polyethylene terephthalate, diacetate, triacetate, cellophane, celluloid, polycarbonate, polyimide, polyvinyl chloride, polyvinylidene chloride, polyacrylate, polyethylene or polypropylene, a board of wood such as veneer, the Japanese cypress or cedar, a glass plate, ceramics, a plate of a metal such as aluminum, iron or copper, a fabric of cotton, rayon, acrylic, nylon, silk, polyester or the like, a skin or leather of cattle, sheep, snake, crocodile or the like, a synthetic leather, a nonwoven fabric, a rubber-like elastic body, mineral paper, or the like. The base material may have either a smooth surface or an irregular surface, or be either transparent, translucent or opaque. Two or more of these base materials may be laminated on each other to be used as the base material. A mat layer, pressure sensitive adhesive release layer or the like may be provided on the opposite side of a printing surface, or a pressure sensitive adhesive layer may be provided on a printing surface after printing. The base material is suitably selected from the above-mentioned materials according to various conditions such as the intended printing application of the resulting printing medium, the use of printed images and the adhesiveness to a composition to be coated thereon. In order to obtain a light-transmitting printing medium, a transparent plastic film or glass sheet is used as the base material, while an opaque plastic film or paper is used as the base material for providing a glossy printing medium.

Upon the preparation of the printing medium according to the present invention, the above-described composition is first of all dissolved or dispersed, together with other additives if necessary, in water, or an alcohol, polyhydric alcohol or another suitable organic solvent to prepare a coating formulation.

The resulting coating formulation is applied to the surface of the base material by, for example, a roll coater, blade coater, air knife coater, gate roll coater, bar coater, size pressing, spray coating, gravure coater or curtain coater method. Thereafter, the thus-coated base material is dried using, for example, a hot-air drying oven or heating drum, thereby obtaining a printing medium according to the present invention.

At this time, it is preferable to bake the coating layer at a temperature of (the MFT of the aqueous resin emulsion contained+120° C.) or lower. If the baking is conducted at a temperature higher than (the MFT+120° C.), the resulting printing medium may undergo marked deterioration in fixing ability and resistance to bleeding, which is considered to be caused by the fact that fusion bonding between the emulsion particles, and film formation are allowed to overprogress upon the formation of a film by the heating, and so the emulsion particles cannot maintain their particle form as described above.

As needed, the resulting printing medium may be further subjected to supercalendering or the like so as to increase the smoothness or surface strength of the ink-receiving layer.

The coat weight of the ink-receiving layer is within a range of from 0.2 to 50 g/m$^2$, preferably from 1 to 30 g/m$^2$ in total. If the coat weight is made small, a part of the base material may be exposed without coating. Any coat weight less than 0.2 g/m$^2$ has no improving effect on coloring ability of the coating formulation compared with the case where no ink-receiving layer is provided. If the coat weight of the ink-receiving layer provided exceeds 50 g/m$^2$ on the other hand, curling occurs to a marked extent, particularly, in a low-temperature and low-humidity environment. The coat weight may preferably be within a range of from 0.5 to 100 μm in terms of thickness.

When ink-jet printing is conducted on the printing medium described above, any known inks may be used with no problem. As recording agents, there may be used water-soluble dyes represented by direct dyes, acid dyes, basic dyes, reactive dyes and food colors, and besides disperse dyes and pigments. They may be used without imposing a particular limitation so far as they are those used in the conventional ink-jet printing. Such water-soluble dyes, disperse dyes or pigments are used in a proportion of 0.1 to 20% by weight in ink.

A solvent suitable for use in water-based inks used in the present invention is water or a mixed solvent of water and a water-soluble organic solvent. Mixed solvents composed of water and a water-soluble organic solvent and containing, as the water-soluble organic solvent, a polyhydric alcohol having an effect of inhibiting the drying of the ink are particularly preferred.

A water-miscible glycol or glycol ether may preferably be used as the water-soluble organic solvent.

A preferred method of conducting printing by applying the above-described ink to the printing medium described above is an ink-jet printing method. As such a method, any system may be used so far as it can effectively eject an ink out of an orifice to apply the ink to the printing medium as a target.

In particular, an ink-jet printing system described in Japanese Patent Application Laid-Open No. 54-59936, in which an ink undergoes a rapid volumetric change by an action of thermal energy applied to the ink, so that the ink is ejected out of an orifice by the working force generated by this change of state, may be used effectively.

Figure 2:
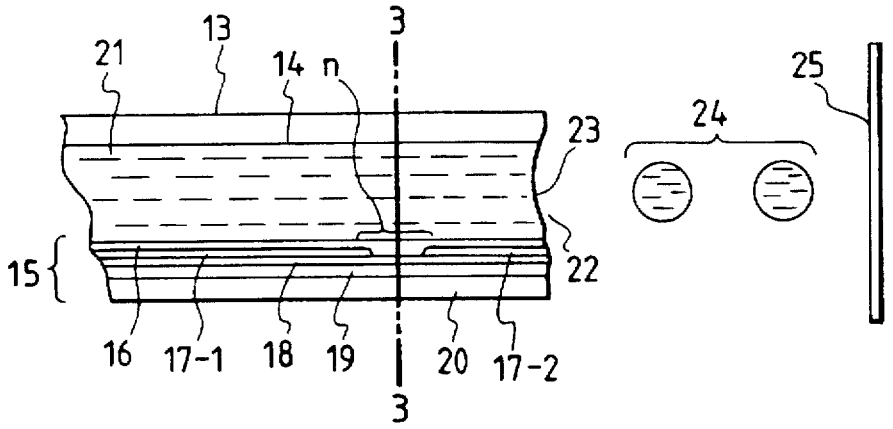
FIG. 2 is a longitudinal cross section of a head of an ink-jet printing apparatus.
Figure 3:
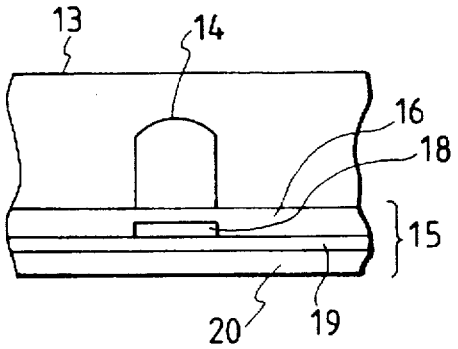
FIG. 3 is a transverse cross section of the head of the ink-jet printing apparatus.
Figure 4:
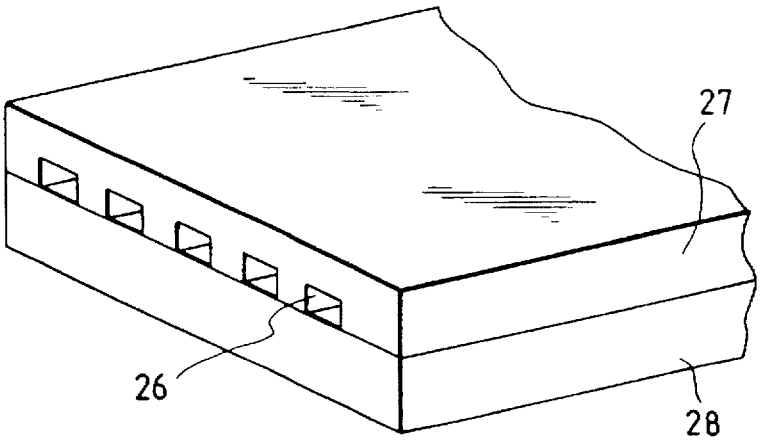
FIG. 4 is a perspective view of the appearance of a multi-head which is an array of such heads as shown in FIG. 2.

An illustrative example of an ink-jet printing apparatus, which is suitable for use in conducting printing using the printing medium according to the present invention, will hereinafter be described. Examples of the construction of a head, which is a main component of such an apparatus, are illustrated in FIGS. 2, 3 and 4.

A head 13 is formed by bonding a glass, ceramic or plastic plate or the like having a groove 14 through which an ink is passed, to a heating head 15, which is used for thermal recording (the drawing shows a head to which, however, is not limited). The heating head 15 is composed of a protective film 16 made of silicon oxide or the like, aluminum electrodes 17-1 and 17-2, a heating resistor layer 18 made of nichrome or the like, a heat accumulating layer 19, and a substrate 20 made of alumina or the like having a good heat radiating property.

An ink 21 comes up to an ejection orifice (a minute opening) 22 and forms a meniscus 23 owing to a pressure P.

Now, upon application of electric signals to the electrodes 17-1, 17-2, the heating head 15 rapidly generates heat at the region shown by n to form bubbles in the ink 21 which is in contact with this region. The meniscus 23 of the ink is projected by the action of the pressure thus produced, and the ink 21 is ejected from the orifice 22 to a printing medium 25 in the form of recording droplets 24. FIG. 4 illustrates an appearance of a multi-head composed of an array of a number of heads as shown in FIG. 2. The multi-head is formed by closely bonding a glass plate 27 having a number of grooves 26 to a heating head 28 similar to the head as illustrated in FIG. 2.

Incidentally, FIG. 2 is a cross-sectional view of the head 13 taken along the flow path of the ink, and FIG. 3 is a cross-sectional view taken along line 3—3 in FIG. 2.

Figure 5:
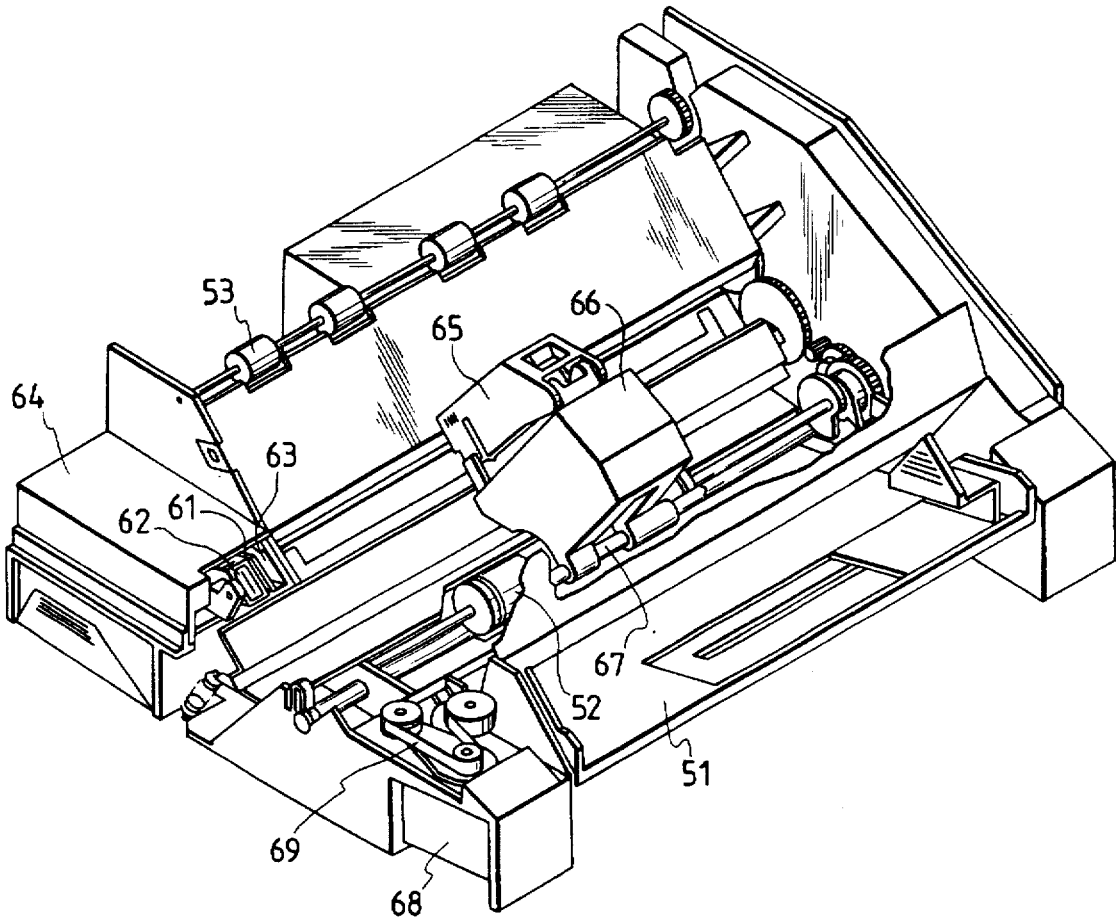
FIG. 5 is a perspective view illustrating an exemplary ink-jet printing apparatus.

FIG. 5 illustrates an example of an ink-jet printing apparatus in which such a head has been incorporated. In FIG. 5, reference numeral 61 designates a blade serving as a wiping member, one end of which is a stationary end held by a blade-holding member to form a cantilever. The blade 61 is provided at the position adjacent to the region in which a printing head operates, and in this embodiment, is held in such a form that it protrudes to the course through which the printing head is moved. Reference numeral 62 indicates a cap, which is provided at the home position adjacent to the blade 61, and is so constituted that it moves in the direction perpendicular to the direction in which the printing head is moved and comes into contact with the face of ejection openings to cap it. Reference numeral 63 denotes an ink-absorbing member provided adjoiningly to the blade 61 and, similar to the blade 61, held in such a form that it protrudes to the course through which the printing head is moved. The above-described blade 61, cap 62 and absorbing member 63 constitute an ejection-recovery portion 64, where the blade 61 and absorbing member 63 remove water, dust and/or the like from the face of the ink-ejecting openings.

Reference numeral 65 designates the printing head having an ejection-energy-generating means and serving to eject the ink onto a printing medium set in an opposing relation with the ejection opening face provided with ejection openings to conduct printing. Reference numeral 66 indicates a carriage on which the printing head 65 is mounted so that the printing head 65 can be moved. The carriage 66 is slidably interlocked with a guide rod 67 and is connected (not illustrated) at its part to a belt 69 driven by a motor 68. Thus, the carriage 66 can be moved along the guide rod 67 and hence, the printing head 65 can be moved from a printing region to a region adjacent thereto.

Reference numerals 51 and 52 denote a paper feeding part from which the printing media are separately inserted, and paper feed rollers driven by a motor (not illustrated), respectively. With such construction, the printing medium is fed to the position opposite to the ejection opening face of the printing head, and discharged from a paper discharge section provided with paper discharge rollers 53 with the progress of printing.

In the above constitution, the cap 62 in the head recovery portion 64 is receded from the moving course of the printing head 65 when the printing head 65 is returned to its home position, for example, after completion of printing, and the blade 61 remains protruded to the moving course. As a result, the ejection opening face of the printing head 65 is wiped. When the cap 62 comes into contact with the ejection opening face of the printing head 65 to cap it, the cap 62 is moved so as to protrude to the moving course of the printing head.

When the printing head 65 is moved from its home position to the position at which printing is started, the cap 62 and the blade 61 are at the same positions as the positions upon the wiping as described above. As a result, the ejection opening face of the printing head 65 is also wiped at the time of this movement.

The above movement of the printing head to its home position is made not only when the printing is completed or the printing head is recovered for ejection, but also when the printing head is moved between printing regions for the purpose of printing, during which it is moved to the home position adjacent to each printing region at given intervals, where the ejection opening face is wiped in accordance with this movement.

The present invention will hereinafter be described more specifically by the following examples. Incidentally, all designations of "part" or "parts" and "%" as will be used in the following examples mean part or parts by weight and % by weight unless expressly noted.

EXAMPLE 1

A composition composed of 100 parts of cationically modified polyvinyl alcohol (trade name: CM-318, product of Kuraray Co., Ltd., saponification degree: about 89 mole %, polymerization degree: about 1,700, cationization degree: about 2 mole %) and 0.7 part, in terms of solids, of finely particulate silica (trade name: Sylicia 470, average particle diameter: 12 μm, product of Fuji Silicia Chemical Co., Ltd.) was dispersed and mixed in water as a medium. The thus-obtained coating formulation was applied to a polyethylene terephthalate film (thickness: 100 μm, trade name: Lumirror, product of Toray Industries, Inc.) using a wire bar to give a binder layer having a dry coat thickness of 10 μm. The film thus coated was then dried at 120° C. for 3 minutes to prepare a printing medium according to the present invention.

Using inks each having the following compositions, color printing was conducted on the printing medium thus obtained under the following conditions by means of an ink-jet printing apparatus in which an ink is ejected by bubbling of the ink by thermal energy.

Composition of ink [black(Bk)]:

| | |
|---|---|
| C.I. Direct Black 19 | 3 parts |
| Glycerol | 6 parts |
| Ethylene glycol | 5 parts |
| Urea | 5 parts |
| Isopropyl alcohol | 3 parts |
| Water | 78 parts |

Surface tension of ink: about 45 dyne/cm.

Composition of ink [yellow (Y), magenta (M), cyan (C)]:

| | |
|---|---|
| Dye | 4 parts |
| Glycerol | 7 parts |
| Thiodiglycol | 7 parts |
| Urea | 7 parts |
| Acetylene glycol | 1.5 parts |
| Water | 73.5 parts |
| Surface tension of ink: | about 35 dyne/cm. |

Dye:

| |
|---|
| Y: C. I. Direct Yellow 86 |
| M: C. I. Acid Red 23 |
| C: C. I. Direct Blue 199. |

Printing conditions:

| | |
|---|---|
| Ejection frequency: | 4 kHz |
| Volume of ejection droplet: | 45 pl |
| Printing density: | 360 DPI |
| Maximum application volume of a single color ink: | 8 nl/mm$^2$. |

EXAMPLE 2

A printing medium was prepared in exactly the same manner as in Example 1 except that the finely particulate silica was changed to 0.8 part, in terms of solids, of another finely particulate silica, Silbead D-MS (average particle diameter: 30 μm, product of Mizusawa Industrial Chemicals, Ltd.) to conduct the color printing thereon by means of the ink-jet printing apparatus in which an ink is ejected by bubbling of the ink by thermal energy.

EXAMPLE 3

A printing medium was prepared in exactly the same manner as in Example 1 except that the finely particulate silica was changed to 0.5 part, in terms of solids, of finely particulate alumina, AX-15S (average particle diameter: 15 μm, product of Nippon Steel Chemical Co., Ltd.) to conduct the color printing thereon by means of the ink-jet printing apparatus in which an ink is ejected by bubbling of the ink by thermal energy.

EXAMPLE 4

A printing medium was prepared in exactly the same manner as in Example 1 except that the cationically modified polyvinyl alcohol was changed to polyvinyl acetal (trade name: Eslec KW-1, product of Sekisui Chemical Co., Ltd.) to conduct the color printing thereon by means of the ink-jet printing apparatus in which an ink is ejected by bubbling of the ink by thermal energy.

EXAMPLE 5

A printing medium was prepared in exactly the same manner as in Example 1 except that the cationically modified polyvinyl alcohol was changed to hydroxyethylcellulose (trade name: AL-15, product of Fuji Chemical K.K.) to conduct the color printing thereon by means of the ink-jet printing apparatus in which an ink is ejected by bubbling of the ink by thermal energy.

EXAMPLES 6 and 7

Printing media were prepared in exactly the same manner as in Example 1 except that art paper and wood free paper were respectively used as base materials.

EXAMPLE 8

A glossy printing medium was prepared in the same manner as in Example 1 except that a plastic film the surface of which is glossy (trade name: Melinex 339, product of ICI Co., Ltd.) was used as the base material and that 0.5 part of a polyamine resin (trade name: Sunfix 555, product of Sanyo Chemical Industries, Ltd.) was added to the coating formulation. Using the obtained printing medium, a color printing was conducted in the same manner as in Example 1.

COMPARATIVE EXAMPLE 1:

A printing medium was prepared in exactly the same manner as in Example 1 except that the finely particulate silica was changed to 0.8 part, in terms of solids, of another finely particulate silica, Mizukasil P-705 (average particle diameter: 1.5 μm, product of Mizusawa Industrial Chemicals, Ltd.) to conduct the color printing thereon by means of the ink-jet printing apparatus in which an ink is ejected by bubbling of the ink by thermal energy.

COMPARATIVE EXAMPLE 2:

A printing medium was prepared in exactly the same manner as in Example 1 except that the finely particulate silica was changed to 0.6 part, in terms of solids, of finely particulate alumina, A-50N (average particle diameter: 1.0 μm, product of Nippon Steel Chemical Co., Ltd.) to conduct the color printing thereon by means of the ink-jet printing apparatus in which an ink is ejected by bubbling of the ink by thermal energy.

COMPARATIVE EXAMPLE 3:

A printing medium was prepared in exactly the same manner as in Example 1 except that the finely particulate silica was changed to 1.0 part, in terms of solids, of a finely particulate hygroscopic acrylic resin, Sanwet IM-5000SP (average particle diameter: 14 μm, product of Sanyo Chemical Industries, Ltd.) to conduct the color printing thereon by means of the ink-jet printing apparatus in which an ink is ejected by bubbling of the ink by thermal energy.

COMPARATIVE EXAMPLE 4:

A printing medium was prepared in exactly the same manner as in Example 1 except that the finely particulate silica was changed to 0.5 part, in terms of solids, of a finely particulate crosslinked polystyrene resin, Fine Pearl PB-3011E (average particle diameter: 11 μm, product of Sumitomo Chemical Co., Ltd.) to conduct the color printing thereon by means of the ink-jet printing apparatus in which an ink is ejected by bubbling of the ink by thermal energy.

COMPARATIVE EXAMPLE 5:

A printing medium was prepared in exactly the same manner as in Example 1 except that the cationically modified polyvinyl alcohol alone was used in a coating formulation to conduct the color printing thereon by means of the ink-jet printing apparatus in which an ink is ejected by bubbling of the ink by thermal energy.

COMPARATIVE EXAMPLE 6:

A printing medium was prepared in exactly the same manner as in Example 1 except that the content of the finely particulate silica was changed to 4 parts in terms of solids to conduct the color printing thereon by means of the ink-jet printing apparatus in which an ink is ejected by bubbling of the ink by thermal energy.

COMPARATIVE EXAMPLE 7:

A printing medium was prepared in exactly the same manner as in Example 1 except that the content of the finely particulate silica was changed to 0.07 part in terms of solids to conduct the color printing thereon by means of the ink-jet printing apparatus in which an ink is ejected by bubbling of the ink by thermal energy.

The resulting color print samples were evaluated in the following items.

[Evaluated items]

(1) Evenness of solid print:

A black solid print and color solid prints (Y, M, C, R, G and B colors) obtained in each example were visually observed either in the form of projected images or as they are to evaluate in evenness and rank as C where beading clearly occurred, and unevenness was conspicuous, B where beading slightly occurred, or A where no beading occurred, and the prints were even.

The beading mentioned in the present invention refers to a phenomenon in which dots irregularly move in the plane direction of the surface of an ink-receiving layer when ink is still fluid before it is fixed in the ink-receiving layer, thus forming new aggregates together with adjacent dots to cause an unevenness in the density of printed images.

(2) Feeding property:

Ten sheets of the film or paper obtained in each example were continuously fed into a printer, BJC-600 (trade name) manufactured by Canon Inc. to evaluate it in feeding property and rank as A where smooth feeding was feasible, B where paper jam slightly occurred, or C where feeding was impossible.

(3) Continuous feeding property:

Thirty sheets of the film or paper obtained in each example were set in an automatic cut sheet feeder of the printer, BJC-600 (trade name) manufactured by Canon Inc. to continuously print a full-color image thereon, thereby evaluating it in continuous feeding property and ranking as A where smooth printing was feasible, and the sheets of the film or paper thus printed underwent no blocking when they are left to stand for 20 minutes after the printing, B where they underwent slight blocking, or C where they underwent complete blocking and were difficult to separate from each other.

(4) OHP suitability:

The printed image obtained in each example was projected on a screen by an OHP, and a projected image formed was visually observed to evaluate it in OHP suitability. It was ranked as A where the printed image was high in optical density, and the projected image had a clear printed area and was high in contrast, bright and easy to read, B where the printed image was somewhat low in optical density and the projected image had somewhat dark unprinted and printed areas, or C where the printed image was considerably low in optical density and the projected image had considerably dark unprinted and printed areas and was lacking in definition.

The evaluation results are shown collectively in Table 1.

TABLE 1

| | Evenness of solid print | Feeding property | Continuous feeding property | OHP suitability |
|---|---|---|---|---|
| Ex. 1 | A | A | A | A |
| Ex. 2 | A | A | A | A |
| Ex. 3 | A | A | A | A |
| Ex. 4 | A | A | A | A |
| Ex. 5 | B | A | A | B |
| Ex. 6 | A | A | A | — |
| Ex. 7 | A | A | A | — |
| Ex. 8 | A | A | A | — |
| Comp. Ex. 1 | A | B | C | A |
| Comp. Ex. 2 | A | B | C | A |
| Comp. Ex. 3 | B | C | C | A |
| Comp. Ex. 4 | A | B | C | A |
| Comp. Ex. 5 | A | C | C | A |
| Comp. Ex. 6 | B | A | A | C |
| Comp. Ex. 7 | A | C | C | A |

EXAMPLE 9

A composition composed of 100 parts of cationically modified polyvinyl alcohol (trade name: CM-318, product of Kuraray Co., Ltd., saponification degree: about 89 mole %, polymerization degree: about 1,700, cationization degree: about 2 mole %), 20 parts, in terms of solids, of an aqueous emulsion of a styrene-acrylate copolymer (trade name: Movinyl 970, product of Hoechst Gosei K.K., solids: 40%, MFT: 100° C.) and 0.7 part, in terms of solids, of finely particulate silica (Sylicia 470) was dispersed and mixed in water as a medium. The thus-obtained coating formulation was applied to a polyethylene terephthalate film (thickness: 100 μm, trade name: Lumirror, product of Toray Industries, Inc.) using a wire bar to give a dry coat thickness of 10 μm. The film thus coated was then dried at 120° C. for 3 minutes to prepare a printing medium according to the present invention.

Using the inks each having the compositions described in Example 1, color printing was conducted on the printing medium thus obtained under the same conditions as those in Example 1 by means of the ink-jet printing apparatus in which an ink is ejected by bubbling of the ink by thermal energy.

EXAMPLE 10

A printing medium was prepared in exactly the same manner as in Example 9 except that the content of the aqueous emulsion of the styrene-acrylate copolymer was changed to 5 parts in terms of solids to conduct evaluation in the same manner as in Example 9.

EXAMPLE 11

A printing medium was prepared in exactly the same manner as in Example 9 except that the content of the aqueous emulsion of the styrene-acrylate copolymer was changed to 10 parts in terms of solids to conduct evaluation in the same manner as in Example 9.

EXAMPLE 12

A printing medium was prepared in exactly the same manner as in Example 9 except that the content of the aqueous emulsion of the styrene-acrylate copolymer was changed to 40 parts in terms of solids to conduct evaluation in the same manner as in Example 9.

EXAMPLE 13

A printing medium was prepared in exactly the same manner as in Example 9 except that the aqueous emulsion of the styrene-acrylate copolymer was changed to an aqueous emulsion of a methacrylate copolymer (trade name: Primal B-88, product of Rohm and Hass Co., solids: 42%, MFT: 90° C.) to conduct evaluation in the same manner as in Example 9.

EXAMPLE 14

A printing medium was prepared in exactly the same manner as in Example 9 except that the aqueous emulsion of the styrene-acrylate copolymer was changed to an aqueous emulsion of an acrylate copolymer (trade name: Movinyl 742N, product of Hoechst Gosei K.K., solids: 46%, MFT: 50° C.) to conduct evaluation in the same manner as in Example 9.

EXAMPLE 15

A printing medium was prepared in exactly the same manner as in Example 9 except that the cationically modified polyvinyl alcohol was changed to another cationically modified polyvinyl alcohol (trade name: C-506, product of Kuraray Co., Ltd., saponification degree: about 74 to 80 mole %, polymerization degree: about 500, cationization degree: about 1 mole %) to conduct evaluation in the same manner as in Example 9.

EXAMPLE 16

A printing medium was prepared in exactly the same manner as in Example 13 except that the cationically modified polyvinyl alcohol was changed to the cationically modified polyvinyl alcohol used in Example 15 to conduct evaluation in the same manner as in Example 9.

EXAMPLE 17

A printing medium was prepared in exactly the same manner as in Example 14 except that the cationically modified polyvinyl alcohol was changed to the cationically modified polyvinyl alcohol used in Example 15 to conduct evaluation in the same manner as in Example 9.

EXAMPLE 18

A printing medium was prepared in exactly the same manner as in Example 9 except that the aqueous emulsion of the styrene-acrylate copolymer was changed to an aqueous emulsion of an acrylate copolymer (trade name: Movinyl 950, product of Hoechst Gosei K.K., solids: 41%, MFT: 0° C.) to conduct evaluation in the same manner as in Example 9.

EXAMPLE 19

A printing medium was prepared in exactly the same manner as in Example 9 except that the aqueous emulsion of the styrene-acrylate copolymer was changed to an aqueous emulsion of an acrylate copolymer (trade name: Primal AC-388, product of Rohm and Hass Co., solids: 50%, MFT: 8° C.) to conduct evaluation in the same manner as in Example 9.

EXAMPLES 20 and 21

Printing media were prepared in the same manner as in Example 9 except that art paper and wood free paper were respectively used as base materials to conduct evaluation in the same manner as in Example 9.

EXAMPLES 22 and 23

Printing media were prepared in the same manner as in Example 9 except that a white PET film (thickness: 100 μm, trade name: White Lumirror, product of Toray Industries, Inc.) and a translucent PET film (thickness: 100 μm, trade name: Lumimat, product of Toray Industries, Inc.) were respectively used as base materials.

EXAMPLES 24 and 25

Printing media were prepared in the same manner as in Example 9 except that an aluminum plate and a copper plate were respectively used as base materials.

EXAMPLE 26

A printing medium was prepared in the same manner as in Example 9 except that cotton cloth was used as a base material.

EXAMPLE 27

A printing medium was prepared in the same manner as in Example 9 except that cowhide was used as a base material, and the periphery of the cowhide was fixed to a frame so as not to shrink upon its drying.

EXAMPLE 28

A printing medium was prepared in the same manner as in Example 22 except that a pressure sensitive adhesive release layer was provided on one side of the base material.

[Evaluated items]

(1) Evenness of solid print:

Evaluation was conducted in the same manner as that in Example 1.

(2) Bleeding between black and color inks:

The resistance to bleeding was ranked as C where bleeding clearly occurred at boundaries between a black printed area and color printed areas (Y, M, C, R, G and B), B where bleeding slightly occurred, or A where no bleeding occurred.

(3) Fixing ability:

After full dot printing was conducted with two inks of a black color and a yellow, cyan or magenta color in an environment of 25° C./60% RH, and the resulting prints were left over for 2 minutes, sheets of NP-DRY paper (product of Canon Inc.) were separately laid on two full dot printed areas with the black ink and the color ink (i.e., yellow, cyan or magenta ink) to rub the printed areas with the NP-DRY paper under a pressure of 4 $Kg/cm^2$. The fixing ability was ranked as C where the inks clearly transferred to the paper when the paper was released, and the printed areas were clearly scratched, B where slight transfer was recognized, and the printed areas were scratched a little, or A where neither transfer nor scratch was recognized.

(4) Stackability after printing:

Printing was continuously conducted using A4-sized printing media, and the resulting prints were stacked one after another. The stackability after printing was ranked as C where a defect in image was clearly recognized due to the stack, B where a minor defect was recognized, or A where no defect was recognized.

(5) OHP suitability:

Evaluation was conducted in the same manner as that in Example 1.

(6) Shelf stability of printed image:

After printing was conducted on each printing medium by means of the above-described printer, and the resulting print was stored for 7 days in an environment of 35° C./90% RH, the shelf stability of image was evaluated in comparison with the image before the storage and ranked as C where ink running, exudation and dot gain occurred, so that image quality was remarkably poor compared with the image before the storage, A where no change was recognized, or B where it was in-between thereof.

The evaluation results are shown collectively in Table 2.

TABLE 2

| | Evenness of solid print | | Bleeding between Bk | Fixing ability | | Stackability | OHP | Shelf stability |
|---|---|---|---|---|---|---|---|---|
| | Bk area | Color area | and color ink | Bk area | Color area | after printing | suitability | of print |
| Ex. 9 | A | A | A | A | A | A | A | A |
| Ex. 10 | A | A | A | A | A | A | A | A |
| Ex. 11 | A | A | A | A | A | A | A | A |
| Ex. 12 | A | A | B | B | A | A | A | A |
| Ex. 13 | A | A | A | A | A | A | A | A |
| Ex. 14 | A | A | A | A | A | A | A | A |
| Ex. 15 | A | A | A | A | A | A | A | A |
| Ex. 16 | A | A | A | A | A | A | A | A |
| Ex. 17 | A | A | A | A | A | A | A | A |
| Ex. 18 | B | A | B | B | B | A | B | A |
| Ex. 19 | B | A | B | B | B | A | B | A |
| Ex. 20 | A | A | A | A | A | A | — | A |
| Ex. 21 | A | A | A | A | A | A | — | A |
| Ex. 22 | A | A | A | A | A | A | — | A |
| Ex. 23 | A | A | A | A | A | A | — | A |
| Ex. 24 | A | A | A | A | A | A | — | A |
| Ex. 25 | A | A | A | A | A | A | — | A |
| Ex. 26 | A | A | A | A | A | A | — | A |
| Ex. 27 | A | A | A | A | A | A | — | A |
| Ex. 28 | A | A | A | A | A | A | — | A |

EXAMPLE 29

A composition composed of 100 parts of cationically modified polyvinyl alcohol (trade name: CM-318, product of Kuraray Co., Ltd., saponification degree: about 89 mole %, polymerization degree: about 1,700, cationization degree: about 2 mole %), 20 parts, in terms of solids, of a vinylpyrrolidone-styrene copolymer (trade name: Antara 430, product of ISP Japan K.K., solids: 40%) and 0.8 part, in terms of solids, of finely particulate silica (Silbead D-MS) was dispersed and mixed in water as a medium. The thus-obtained coating formulation was applied to a polyethylene terephthalate film (thickness: 100 μm, trade name: Lumirror, product of Toray Industries, Inc.) using a wire bar to give a dry coat thickness of 10 μm. The film thus coated was then dried at 120° C. for 3 minutes to prepare a printing medium according to the present invention.

Using the inks each having the compositions described in Example 1, color printing was conducted on the printing medium thus obtained under the same conditions as those in Example 1 by means of the ink-jet printing apparatus in which an ink is ejected by bubbling of the ink by thermal energy.

EXAMPLE 30

A printing medium was prepared in the same manner as in Example 29 except that the content of the vinylpyrrolidone-styrene copolymer was changed to 5 parts in terms of solids to conduct the color printing.

EXAMPLE 31

A printing medium was prepared in the same manner as in Example 29 except that the content of the vinylpyrrolidone-styrene copolymer was changed to 100 parts in terms of solids to conduct the color printing in the same manner as in Example 29.

EXAMPLE 32

A printing medium was prepared in the same manner as in Example 29 except that the content of the vinylpyrrolidone-styrene copolymer was changed to 300 parts in terms of solids to conduct the color printing.

EXAMPLE 33

A printing medium was prepared in the same manner as in Example 29 except that the vinylpyrrolidone-styrene copolymer was changed to a vinylpyrrolidone-ethyl acrylate copolymer (trade name: Antara 130, product of ISP Japan K.K., solids: 40%) to conduct the color printing.

EXAMPLE 34

A printing medium was prepared in the same manner as in Example 29 except that the cationically modified polyvinyl alcohol was changed to another cationically modified polyvinyl alcohol (trade name: C-506, product of Kuraray Co., Ltd., saponification degree: about 74 to 80 mole %, polymerization degree: about 500, cationization degree: about 1 mole %) to conduct the color printing.

EXAMPLE 35

A printing medium was prepared in the same manner as in Example 29 except that the cationically modified polyvinyl alcohol was changed to unmodified polyvinyl alcohol (trade name: PVA217, product of Kuraray Co., Ltd., saponification degree: about 88 mole %, polymerization degree: about 1,700) to conduct the color printing.

EXAMPLE 36

A printing medium was prepared in the same manner as in Example 29 except that the cationically modified polyvinyl alcohol was changed to polyvinyl acetal (trade name: KW-1, product of Sekisui Chemical Co., Ltd.) to conduct the color printing.

EXAMPLE 37

A printing medium was prepared in the same manner as in Example 29 except that the cationically modified polyvinyl alcohol was changed to hydroxyethylcellulose (trade name: AL-15, product of Fuji Chemical K.K.) to conduct the color printing.

EXAMPLE 38

A printing medium was prepared in the same manner as in Example 29 except that the cationically modified polyvinyl alcohol was changed to polyethylene oxide (trade name: Alkox R-1000, product of Meisei Chemical Works, Ltd.) to conduct the color printing.

EXAMPLE 39

A printing medium was prepared in the same manner as in Example 29 except that the vinylpyrrolidone-styrene copolymer was changed to a vinylpyrrolidone-vinyl acetate copolymer (trade name: S360, product of ISP Japan K.K.) to conduct the color printing.

EXAMPLES 40 and 41

Printing media were prepared in the same manner as in Example 29 except that art paper and wood free paper were respectively used as base materials to conduct the color printing.

[Evaluated items]

Evaluation was conducted as to the same items (1) to (6) as those described in Example 9. Further, evaluation as to haze degree of film was added.

(7) Haze degree of film:

An image obtained by printing on each printing medium sample by means of the printer described above was projected by a transmission type OHP, thereby evaluating it in haze degree and ranking as C where haze developed and the projected image was dark, A where no problem occurred, or B where the projected image was somewhat dark.

The evaluation results are shown collectively in Table 3.

TABLE 3

| | Evenness of solid print | | Bleeding between Bk | Fixing ability | | Stackability | OHP | Shelf stability | Haze degree |
|---|---|---|---|---|---|---|---|---|---|
| | Bk area | Color area | and color ink | Bk area | Color area | after printing | suitability | of print | of film |
| Ex. 29 | A | A | A | A | A | A | A | A | A |
| Ex. 30 | A | A | A | A | A | A | A | A | A |
| Ex. 31 | A | A | A | A | A | A | A | A | A |
| Ex. 32 | A | A | A | A | A | A | A | A | A |
| Ex. 33 | A | A | A | A | A | A | A | A | A |
| Ex. 34 | A | A | A | A | A | A | A | A | A |
| Ex. 35 | B | A | B | A | B | A | A | B | A |
| Ex. 36 | B | A | B | A | A | A | A | B | A |
| Ex. 37 | B | A | A | A | A | A | A | B | A |
| Ex. 38 | A | A | B | A | A | A | B | B | B |
| Ex. 39 | A | B | B | A | A | A | A | B | A |
| Ex. 40 | A | A | A | A | A | A | — | B | A |
| Ex. 41 | A | A | A | A | A | A | — | B | A |

Further, the printing media prepared in Examples 9 through 40 had the same feeding property and continuous feeding property as shown in Examples 1 through 8.

According to the present invention, as described above, there can be provided printing media which are excellent in ink absorptivity to a variety of inks having various properties, provide dots bright and high in optical density, can form high-definition images excellent in evenness and free of bleeding, and besides are excellent in feeding property and continuous feeding property in various printers and also superb in transparency.

According to the present invention, there can also be provided printing media having, in addition to the above-described effects, ideal performance requirements that ink fixing ability and stackability after printing are excellent, and shelf stability of images formed is also excellent, and so the images undergo no deterioration even when left to stand for a long period of time in a high-temperature and high-humidity environment.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded to the broadest interpretation so as to encompass all such modifications and equivalent structures and functions.

What is claimed is:

1. A printing medium comprising a base material and an ink-receiving layer which comprises inorganic fine particles and a resin and is provided on the base material, wherein the inorganic fine particles partly project from a resin layer of the ink-receiving layer and are contained in a proportion of 0.05 to 3 parts per 100 parts of the resin in terms of solids.

2. The printing medium according to claim 1, wherein the base material is a plastic film.

3. The printing medium according to claim 2, wherein the plastic film is transparent.

4. The printing medium according to claim 1, wherein the base material is a paper web.

5. The printing medium according to claim 1, wherein the diameter of the inorganic fine particles is greater than the thickness of the resin layer.

6. The printing medium according to claim 5, wherein the diameter of the inorganic fine particles is not greater than five times the thickness of the resin layer.

7. The printing medium according to claim 1, wherein the resin layer comprises cationically modified polyvinyl alcohol.

8. The printing medium according to claim 1, wherein the ink-receiving layer has transparency or surface gloss.

9. The printing medium according to claim 1, wherein the inorganic fine particles comprise fine particles selected from the group consisting of silica, alumina, aluminum silicate, magnesium silicate, basic magnesium carbonate, talc, clay, hydrotalcite, calcium carbonate, titanium oxide and zinc oxide.

10. The printing medium according to claim 1, wherein the inorganic fine particles are fine particles of silica.

11. A printed article comprising a printing medium bearing an image, said printing medium comprising a base material and an ink-receiving layer which comprises inorganic fine particles and a resin and is provided on the base material, wherein the inorganic fine particles partly project from a resin layer of the ink-receiving layer and are contained in a proportion of 0.05 to 3 parts per 100 parts of the resin in terms of solids.

12. The printed article according to claim 11, wherein the base material is a plastic film.

13. The printed article according to claim 12, wherein the plastic film is transparent.

14. The printed article according to claim 11, wherein the base material is a paper web.

15. The printed article according to claim 11, wherein the diameter of the inorganic fine particles is greater than the thickness of the resin layer.

16. The printed article according to claim 15, wherein the diameter of the inorganic fine particles is not greater than five times the thickness of the resin layer.

17. The printed article according to claim 11, wherein the resin layer comprises cationically modified polyvinyl alcohol.

18. The printed article according to claim 11, wherein the ink-receiving layer has transparency or surface gloss.

19. The printed article according to claim 11, wherein the inorganic fine particles comprise fine particles selected from the group consisting of silica, alumina, aluminum silicate, magnesium silicate, basic magnesium carbonate, talc, clay, hydrotalcite, calcium carbonate, titanium oxide and zinc oxide.

20. The printed article according to claim 11, wherein the inorganic fine particles are fine particles of silica.

* * * * *

UNITED STATES PATENT AND TRADEMARK OFFICE

CERTIFICATE OF CORRECTION

PATENT NO. : 5,747,146

DATED : May 5, 1998

INVENTOR(S) : AKIO KASHIWAZAKI, ET AL.

It is certified that error appears in the above-identified patent and that said Letters Patent is hereby corrected as shown below:

ON THE TITLE PAGE,

At [56] References Cited

"3025352" should read --3-025352--

Column 6

Line 15, "in-dots" should read --in dots--.

Column 7

Line 57, "1/9to" should read --1/9 to--.

Column 9

Line 21, "compared," should read --compared--.

Signed and Sealed this

Eighteenth Day of May, 1999

*Attest:*

Q. TODD DICKINSON

*Attesting Officer*

*Acting Commissioner of Patents and Trademarks*